US007634874B2

(12) United States Patent
Lucas

(10) Patent No.: US 7,634,874 B2
(45) Date of Patent: Dec. 22, 2009

(54) COLLAPSIBLE STRUCTURAL MEMBERS

(75) Inventor: Nicholas G. Lucas, Nokomis, FL (US)

(73) Assignee: Luco-Ed Enterprises LLC, Girard, PA (US)

( * ) Notice: Subject to any disclaimer, the term of this patent is extended or adjusted under 35 U.S.C. 154(b) by 400 days.

(21) Appl. No.: 11/405,968

(22) Filed: Apr. 18, 2006

(65) Prior Publication Data

US 2007/0261320 A1 Nov. 15, 2007

(51) Int. Cl.
*E04H 12/18* (2006.01)

(52) U.S. Cl. ..... 52/108; 52/223.9; 52/641; 52/645

(58) Field of Classification Search ..... 52/100, 52/694, 86, 223.1, 223.14, 726.1, 223.8, 52/223.9, 645, 646, 641, 108, 222, 223.5, 52/223.7, 223.11, 223.13, 227, 578, 286; 74/479; 248/104, 160; 446/85, 117, 124; 464/19, 147

See application file for complete search history.

(56) References Cited

U.S. PATENT DOCUMENTS

| | | | | | |
|---|---|---|---|---|---|
| 816,240 | A * | 3/1906 | Mehlig | 464/115 |
| 835,215 | A * | 11/1906 | Coates | 464/115 |
| 897,349 | A * | 9/1908 | Coates | 464/115 |
| 1,276,117 | A * | 8/1918 | Riebe | 464/171 |
| 1,279,803 | A * | 9/1918 | Watson | 248/160 |
| 2,912,837 | A * | 11/1959 | Brodbeck | 251/96 |
| 3,053,358 | A * | 9/1962 | Gross | 52/108 |
| 3,584,822 | A * | 6/1971 | Oram | 248/160 |
| 3,604,203 | A * | 9/1971 | Hofmann | 59/80 |
| 3,708,944 | A * | 1/1973 | Miyake | 52/745 |
| 3,754,779 | A * | 8/1973 | Peress | 285/11 |
| 3,857,213 | A * | 12/1974 | Miyake | 52/86 |
| 3,858,578 | A * | 1/1975 | Milo | 600/229 |
| 4,259,825 | A | 4/1981 | Hedgepeth et al. | 52/645 |
| 4,685,349 | A | 8/1987 | Wada et al. | 74/479 |
| 4,739,801 | A * | 4/1988 | Kimura et al. | 138/120 |
| 4,887,397 | A * | 12/1989 | Peterson | 52/86 |
| 4,949,927 | A * | 8/1990 | Madocks et al. | 248/276.1 |
| 5,441,364 | A * | 8/1995 | Dressler | 405/119 |
| 5,449,206 | A * | 9/1995 | Lockwood | 285/261 |
| 5,620,352 | A * | 4/1997 | Tzong | 446/120 |
| 5,797,234 | A * | 8/1998 | Theodorou | 52/578 |
| 5,997,047 | A * | 12/1999 | Pimentel et al. | 285/55 |
| 6,110,002 | A * | 8/2000 | Langton | 446/375 |
| 6,131,357 | A | 10/2000 | Martin-Lunas Sourdeau | 52/694 |
| 6,296,644 | B1 * | 10/2001 | Saurat et al. | 606/256 |
| 6,478,653 | B1 * | 11/2002 | Langton | 446/373 |
| 6,606,921 | B2 * | 8/2003 | Noetzold | 74/502.3 |
| 6,686,717 | B2 | 2/2004 | Khairallah | 318/568.11 |

* cited by examiner

*Primary Examiner*—Robert J Canfield
*Assistant Examiner*—Matthew J Gitlin
(74) *Attorney, Agent, or Firm*—Miles & Stockbridge P.C.; David R. Schaffer, Esq.

(57) ABSTRACT

A collapsible structural member has been provided in which substantially identical modules made up of metal or plastic are threaded on a tensioning member such as a cable and are movable relative to each other in the collapsed condition of the beam and are brought together into a condition where adjacent modules are locked together to form a rigid construction when the beam is in its erected operating condition. The beam is changed from its erected condition to its collapsed condition by relaxing the tensioning member or cable.

17 Claims, 5 Drawing Sheets

COLLAPSIBLE STRUCTURAL MEMBERS

FIELD OF THE INVENTION

This invention relates to collapsible structural members or beams and more particularly to collapsible structural members which use substantially identical modules to form beam which are rigid in three dimensions.

BACKGROUND OF THE INVENTION

Various collapsible members have been used to form beams for collapsible structures such as temporary buildings and tents and also for work arms to position working tools in awkward locations. The collapsible structural members typically employ cables as tensioning members to bring separate segments or modules together to form a rigid structure. Such prior art structures usually rely on the cable itself to provide rigidity to the member or to separate pins or fasteners which must be installed to obtain rigidity and must be removed to permit collapse of the structure. Usually collapsible structural members require multiple parts and also require substantial time to form a structure and to collapse that structure.

There is a need for a collapsible structural member which is simple to erect and to collapse and uses a minimum number of parts. It appears also that there is a need for a collapsible structural member which uses a tensioning member to bring the parts together but which locks them in a position so that they are not reliant on the tensioning member for rigidity or strength.

An object of the invention is to provide a collapsible structural member which is simple and eliminates the need for many removable parts.

Another object of the invention is to provide a collapsible structure member where a tensioning member is used to bring components, segments or modules of the structure together and into a position in which the components lock together frictionally and are maintained in the locked position without undue loading required on the tensioning member.

A further object of the invention is to provide a collapsible beam structure which uses frictional locking principles similar to that used in Morse tapers for locking tapered drill bits and complementary tapered rotatable chucks to provide frictional locking between the drill and the chuck to transmit rotational torque.

Still another object of the invention is to provide a collapsible beam structure having the ability of locking adjacent modules relative to each other using complementary spherical locking surfaces to provide a frictional lock required to hold the modules in a rigid position relative to each other whether the modules are aligned axially or at an angle to each and independently of the cable or tensioning member.

SUMMARY OF THE INVENTION

The objects of the invention are attained by a collapsible structural member utilizing a plurality of substantially identical adjacent modules with each of the modules including an elongated body with a pair of oppositely facing walls forming a head at one end and a skirt forming a socket at the other end to receive the head of an adjacent module. Each of the heads forms a pair of outwardly facing spherical concave locking surfaces facing away from each other and the skirts of each of the modules form concave complementary spherical locking surfaces facing each other. A passage is formed within the modules to extend longitudinally from the head and through the skirt to receive a tensioning member in the form of a cable.

Upon application of the tension to the cable at the skirt of an end module of a number of modules on the cable to bring the pair of convex spherical locking surface of the head portions of each module into frictional locking engagement with a pair of concave locking surfaces of an adjacent one of the modules to form a lock between the adjacent modules of all of the modules. Stops are formed on each module to determine the angular relation of the modules so that the collapsible beam can be curved or straight and to form a rigid but collapsible structural member. The cable is used to maintain the position of the modules and upon release permits the cable to be collapsed.

DESCRIPTION OF THE INVENTION

Figure 1:
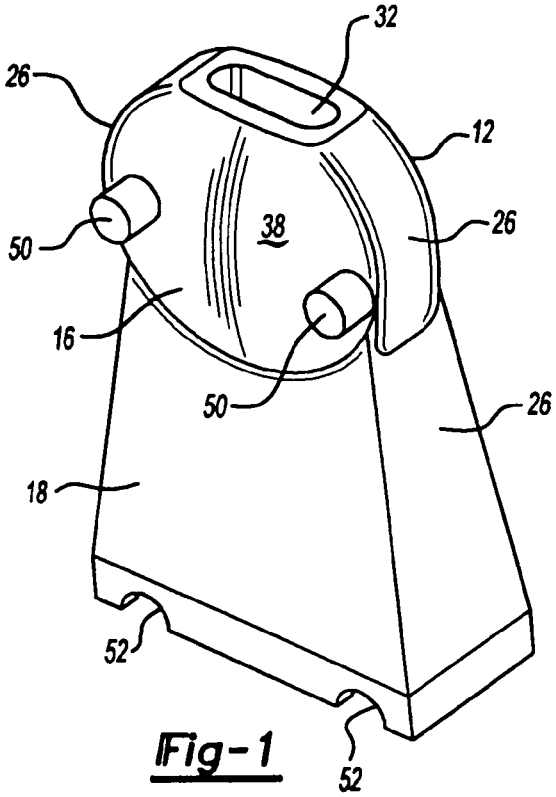
FIG. 1 is a perspective view of a single module used to form a collapsible structural member.

The present invention utilizes a concept of spherical frictional locking surfaces.

A common example of a frictional locking surface is the conical form found in the Morse taper invented by Steven A. Morse about 1864 and still in wide commercial use in drill presses and lathes. In such a locking arrangement the conical end of a shaft of a tool or drill bit has an included angle at the apex of about seven degrees (7°) or less. When the tool is inserted in a chuck having a complementary conical socket with the same included angle, friction alone maintains the tool in the socket. A small axial force applied to the tool to bring the tapered locking surfaces into engagement with each other is sufficient to frictionally lock the shank of the tool in torque transmitting relationship to the socket. A similar axial force in the opposite direction is applied to disconnect the tapered locking surfaces from each other.

The locking surfaces employed in the present invention uses opposed complementary spherical locking surfaces to form a frictional locking angle of about seven degrees (7°) or less. The spherical surfaces are used to accommodate angled positions of modules relative to each other.

A collapsible beam 10 of the present invention is made up of a plurality of modules or beads 12. The modules 12 are substantially identical to each other when the beam 10 is to be straight and vary only slightly from each other if any portion of the beam is to be curved. The modules required for straight beams or those curved in a single plane will be discussed first.

Each module 12 of the plurality of modules forming a collapsible beam 10 has a generally flat and elongated body portion 14 with a head 16 at one end and a skirt 18 at the other end forming a receiving socket 20 for the head 16 of an adjacent module 12.

Figure 2:
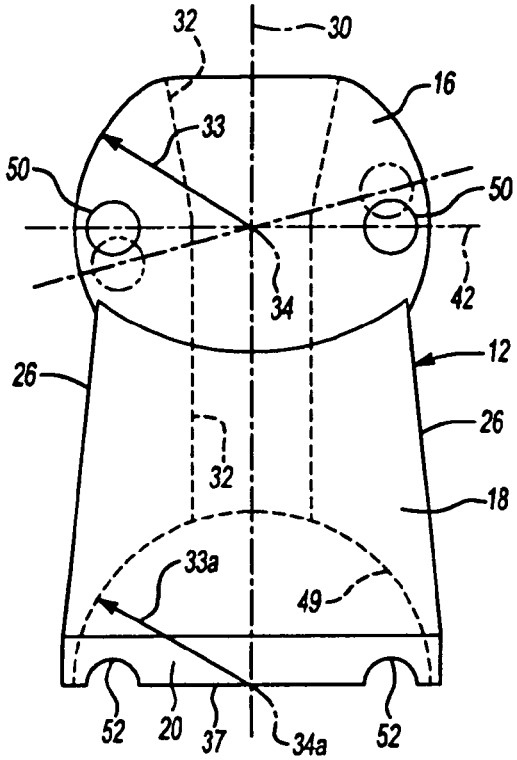
FIG. 2 is a front elevation of one of the modules.
Figure 3:
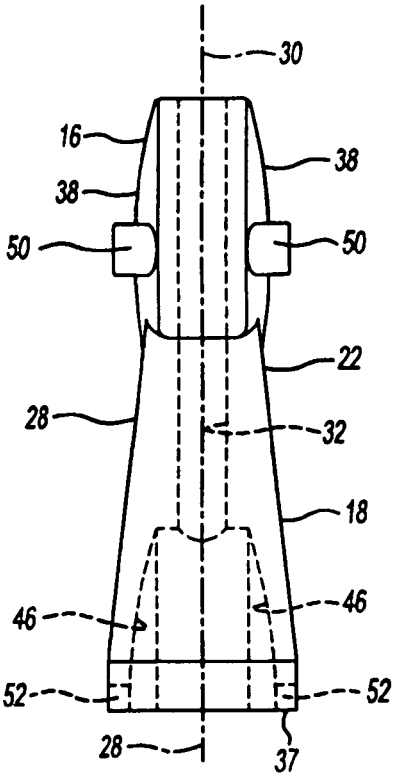
FIG. 3 is a side elevation of one of the modules.
Figure 4:
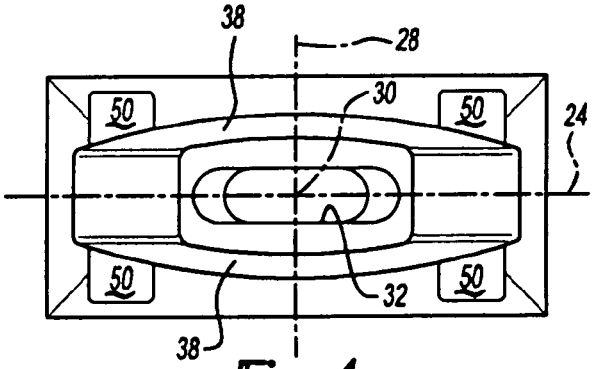
FIG. 4 is a top view of the modules seen in the preceding figures.

Each module 12 is generally flat with front and back walls 22 which are identical to each other but facing in opposite directions from an imaginary longitudinal plane indicated at 24 in FIGS. 3 and 4. Also, the modules 12 have opposite side walls 26 which face away from each other and are identical in shape. The side walls 26 are spaced equally to opposite sides of another imaginary plane 28 intersecting the first mentioned imaginary plane 24 at a right angle as seen in FIGS. 2 and 4. All of the opposed wall surfaces 22 and 26 are symmetrical to a longitudinal axis 30 formed at the intersection of planes 24 and 28 as seen in FIG. 4. The longitudinal axis 30 is coaxial with a passage 32 as best seen in FIGS. 2 and 3. The position of the imaginary planes 24 and 28 as well as the longitudinal axis 30 are also indicated in FIGS. 4.

Figure 5:
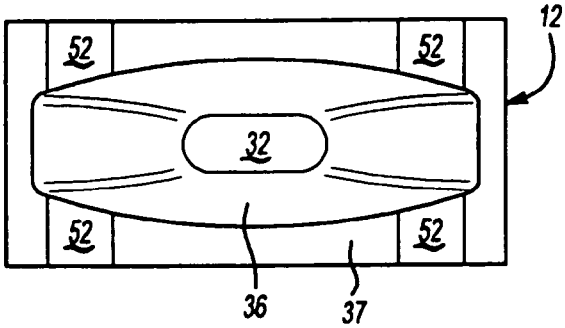
FIG. 5 is a bottom view of the modules seen in FIGS. 1-3.

The side walls 26 of the head 16 are portions of the circumference of a circle with the center of radius 33 being located at the point 34 as seen in FIG. 2 with the diameter of the circular walls being slightly less than an opening 36 formed in end wall 37 as an entrance to socket 20 in skirt 18 as seen in FIG. 5.

Figure 9:
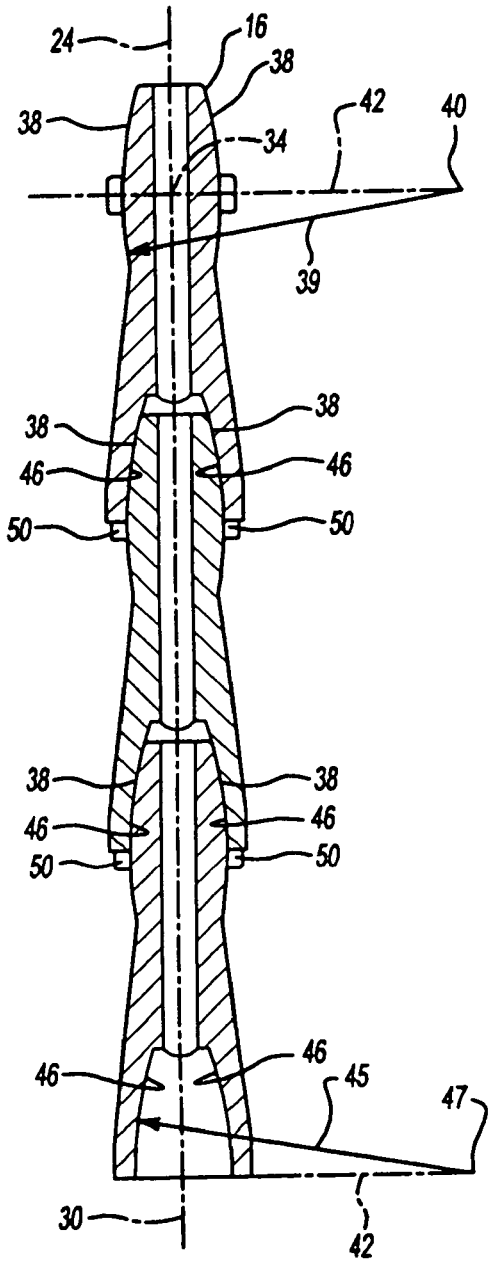
FIG. 9 is a cross sectional view taken on line 9-9 in FIG. 7.

Front and back walls 22 of head 16 have identical convex surfaces 38 which are formed by opposed segments of a sphere having a radius 39 centered at point 40 in FIG. 9 and extending to the opposite side of longitudinal plane 24 and disposed in a transverse plane 42 that passes through the center 34 of the radius for circular side walls 26 of head 16 as seen also in FIG. 2. As seen in FIG. 9, the two convex segments 38 of the sphere face in opposite directions and are relatively closely spaced to each other to form a relatively thin and flat head 16.

By making the radius approximately the length of the illustrated modules as illustrated in the drawings, the appropriate seven-degree (7°) or less included angle for frictional locking will be obtained. In the present case, if the overall length of the module is about three inches, the radius 39 could be approximately three inches and centered at 40 as seen in FIG. 9 to form one of the convex spherical frictional locking surfaces. The opposed convex spherical locking surfaces 38 forming the head 16 can be visualized by considering diametrically opposed equal segments of the sphere brought close together as seen in FIG. 9 for each of the modules.

The sockets 20 in the skirts 18 of each of the modulesl2 are provided with a pair of concave spherical locking surfaces 46 which face each other and are complementary to the spherical convex locking surfaces 38 on the head 16 of an adjacent module.

The concave locking surface 46 in socket 20 are generated with a radius 45 substantially equal to radius 42 used to form the complementary spherical locking surface 38 with the convex shape. Referring to FIG. 9 and to the lower one of the modules 12, transverse plane 42 coincides with the end wall 37 of the skirt 18. The convex-concave matching frictional locking surfaces with the spherical shape are found to approximate the under seven-degree (7°) taper angle of Morse tapers common with conical connections. Also, the spherical frictional locking surfaces 38 and 46 are desirable to form curved collapsible beams since the taper locking surfaces are effective when adjacent modules 12 have their longitudinal axes 30 aligned or at an angle to each other. As seen in FIG. 2 the circular sides 49 of socket 20 defining the opposite edges of the concave locking surfaces 46 are defined by radius extending from point 37A at the intersection of longitudinal axis 30 and end wall 37 of skirt 18. Radius 37A is substantially equal to radius 37. The circular, concave side walls 49 of the socket 20 are complementary to the convex circular side walls 26 of the heads of adjacent modules.

Figure 8:
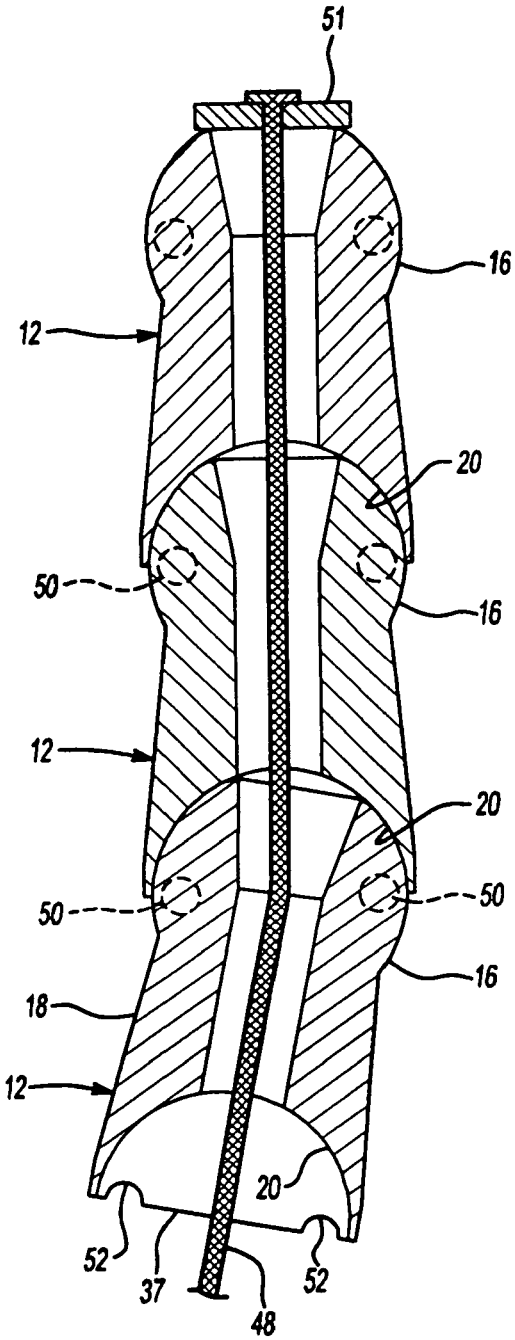
FIG. 8 is a cross sectional view of the modules seen in FIG. 7 showing the position of the tensioning cable within the modules.

The passages 32 formed longitudinally of each module 12 serve to receive a cable or tensioning member 48 in which the modules or beads 12 are strung as best seen in FIG. 8. The cable 48 serves to maintain the modules 12 aligned with each other when the beam 10 is in its collapsed condition. When tension is applied to the cable 48, which can be to either end of a collapsible structural member 10 and as shown in FIG. 8 is anchored to the head 16 at a point indicated at 51. Upon tightening the cable 48 at its opposite end, the head portions 16 are brought into locking engagement in the sockets 20 in adjacent modules of all of the modules on the cable 48 to form a rigid beam as will be described. It will be noted that the axial opening 32 is much wider than required for a single cable 48. This is provided to accommodate additional cables to activate or apply tension to portions of a collapsible beam or to branch beam portions (not shown).

The plurality of adjacent modules 12 in a collapsible beam 10 are maintained in line with each other by the cable or other tensioning member 48 extending in axial passage 32 in each of the modules 12 as best seen in FIG. 8. The cable has been omitted in most of the other figures to simplify the drawings. The passages 32 and the cable 48 are so arranged that the modules 12 are in substantial alignment with each other in the collapsed condition of the structural members 10 with a portion of the head 16 in the socket 20 of an adjacent module as illustrated by the two modules in FIG. 6. With cable 48 anchored to a first module, the application of tension to the cable 48 at another module 12 tends to bring adjacent modules 12 together to bring the convex locking surfaces 38 on the head 16 of each module 12 into locking engagement with the complementary and concave locking surfaces in the socket 20 in the adjacent module. The tension can be applied to the cable by a winch 56 shown diagrammatically in FIGS. 13 and 14 and operated either manually or by power. Thereafter, the loading of the cable 48 is such that only enough tension must be maintained to prevent the modules from changing position relative to each other. The strength or rigidity of the beam 10 is not dependent solely on the tension in the cable 48 which needs to be only high enough to maintain the adjacent modules in position relative to each other.

The straight or angled position of adjacent modules 12 in their interlocked relation is determined by a pair of stop elements 50 formed on each of the front and back walls 22 of the head 16 of each of the modules 12 as seen in FIGS. 2 and 3. The pairs of stop elements 50 are coaxial to each other as seen in FIGS. 3 and 4 and are disposed equally from opposite sides of plane 28 that intersects the longitudinal axis 30 and longitudinal plane 24 at a right angle. The stop elements 50 on front and back walls 22 of the modules are aligned with each other and are spaced equally from the longitudinal axis 30 of each head portion. Also, all four of the stop elements 50 can be regarded as disposed in the same plane 42 that also passes through radius center 40 for spherical locking surfaces 38 as seen in FIG. 9.

Figure 6:
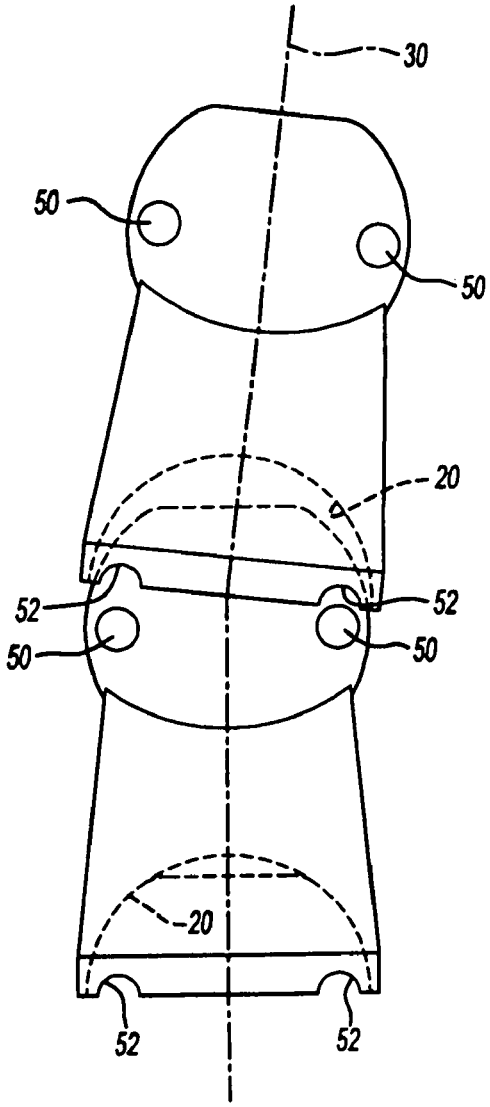
FIG. 6 shows two adjacent modules in an aligned position just prior to locking.
Figure 7:
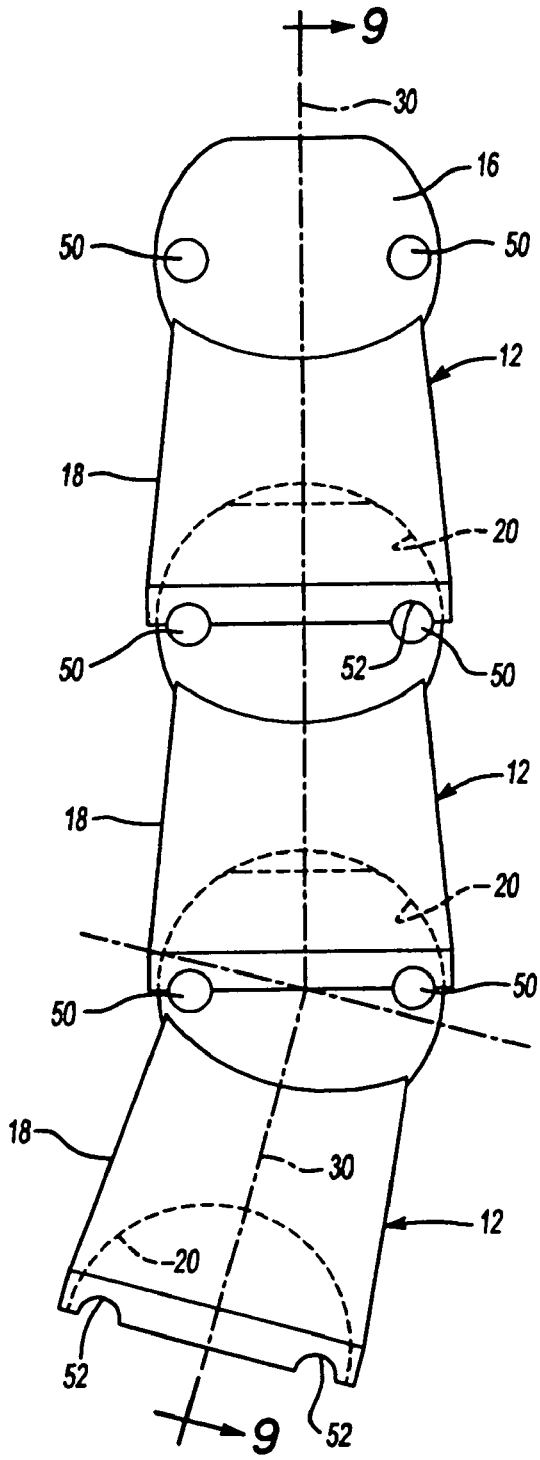
FIG. 7 shows three adjacent modules in their locked position.

The four stop elements 50 are adapted to engage four stop recesses or notches 52 formed in the end wall 37 of the skirt 18 of an adjacent module 12. The end walls 37 on skirts 18 coincide with the transverse plane 42 so that as seen in FIGS. 6 and 7 the stop elements 50 are engaged with the stop recess 52 and the top two adjacent modules 12 in FIGS. 7 and 8 are aligned with each other in a straight line. If the modules or beads 12 are to be at an angle with each other, the stop elements 50 are repositioned by moving them in an arc about radius center 34 out of reference plane 42 in FIG. 2. By way of example, if the adjacent modules are to be at a fifteen-degree (15°) angle to each other, the stop elements 50 are moved from their original transverse position in FIG. 2 through an arc of fifteen degrees (15°) to the transverse plane 42 about the center 34 midway of stop elements 50 as illustrated also in FIG. 6 for the bottom module 12. The axially aligned stop elements 50 at each side of head 16 are moved equally in opposite directions in an arc of fifteen degrees (15°) about radius center 34 from the original transverse position.

In the preferred embodiment of the invention shown in FIGS. 1 through 9 maximum angle of adjacent modules is approximately twenty-two and one half degrees (22½°) to insure efficient operation of the cable or tension member 46.

The modules for any given size are molded of plastic material and the only differences between modules for straight beams and for curved beams is the position of the stop elements 50. To create a collapsible structural member 10 only a few different modules are required namely those for straight beam portions and those for curved beam portions. Even here the inventory is simplified because modules for angled connection form an angle either to the left or to the right by simply turning the module one hundred eighty degrees (180°) about its longitudinal axis 26.

Thus far the modules 12 had been described as substantially identical except for the positioning of stop elements 50 to make curves in the collapsible structural member 10. However, in FIG. 10 the module 12A has been elongated by changing the distance between the head 16 and the socket 20 in skirt portion 18 which remain identical to the head 16 and socket 20 of the prior modules. Only the body member 14 has been changed by elongation as indicated by the bracket at 53 in FIG. 10 to space the head 16 at some greater selected distance from the socket 20 in skirt 18. In all other respects the module 12 remains the same except for the possible positions of stop elements 50.

Figure 11:
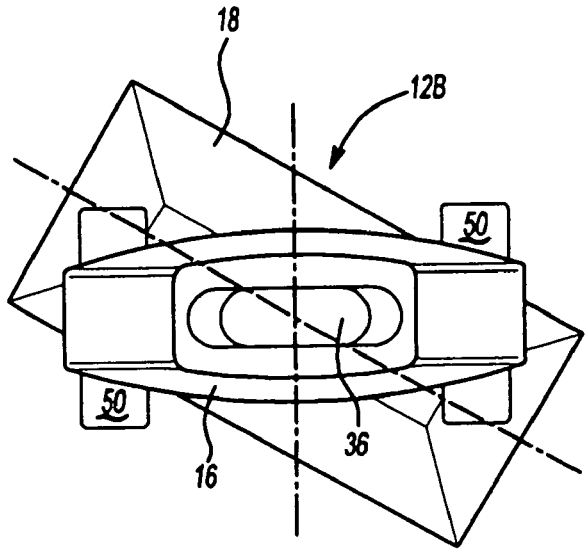
FIG. 11 is a view similar to FIG. 4 showing another modification of the module with the head portion of the module rotated slightly relative to the skirt portion for the purpose of changing the direction of curves in a collapsible structural member.
Figure 13:
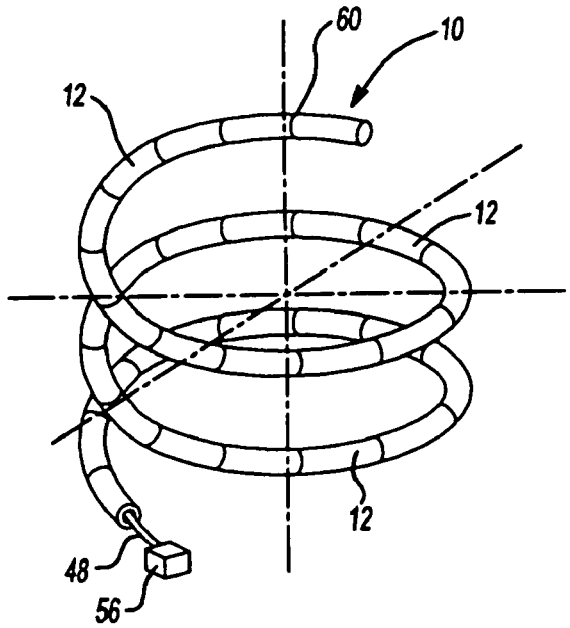
FIG. 13 is a diagrammatic showing of a plurality modules of FIGS. 1 through 8 showing a collapsible structural member curved in a coil or in three dimensions.

A further modification can be made to the modules 12 in the event a collapsible structural beam is to be curved in more than a single plane, that is a three-dimensional curve or for example such as that that would occur in a spiral on helix as illustrated diagrammatically in FIG. 13. In that case, a module 12B can be formed as a unitary module by rotating the head 16 relative to the skirt 18 and socket 20 about the longitudinal axis 30 of the module as seen in FIG. 11. The angle of head 16 can be up to a full ninety degrees (90°) relative to skirt 18, if desired, since it would not affect the operation of the tensioning member or cable 48.

Figure 12:
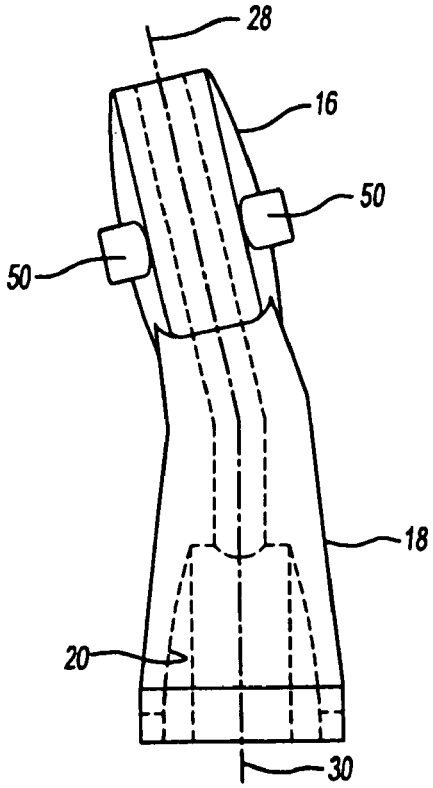
FIG. 12 is a view similar to FIG. 3 showing a modified module with the head displaced relative to the skirt to form three-dimensional curved beam.

Still another variation of modules 12 can be made by bending the head 16 relative to skirt 18 out of the longitudinal plane 24 as seen in FIG. 12 to form module 12C. This variation of the module can also be used to form three-dimensional curved beams such as a helix shown diagrammatically in FIG. 13. The tensioning members 48 should be in a path that avoids kinking of the cable and for that reason the angle of displacement of the head 16 relative to the skirt 18 should not exceed about fifteen degrees (15°).

Figure 10:
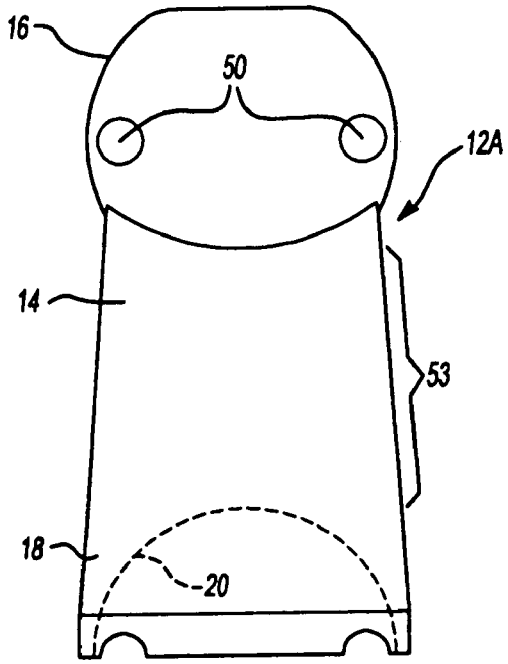
FIG. 10 is a modified version of the module of the collapsible structural member embodying the invention shown in FIG. 2.

In all of the modifications of the basic module 12 seen in FIGS. 10, 11 and 12 the head 16 and socket 20 in skirt portions 18 remain unchanged. Only the body portion 14 between the head 16 and skirt 18 change by either stretching, as shown for module 12A in FIG. 10, by twisting, as shown for module 12B in FIG. 11, or by bending for module 12C, as seen in FIG. 12. In all of the modifications, the head and socket 20 in skirt 18 operate as in the first embodiment. Also, the stops 50 and recesses 52 operate in the same way for all versions of the modules.

A three-dimension beam 60 is shown in FIG. 13 in a form of a spiral. The beam 60 would require not only the basic module 12 but a few of the modules 12B or 12C.

Figure 14:
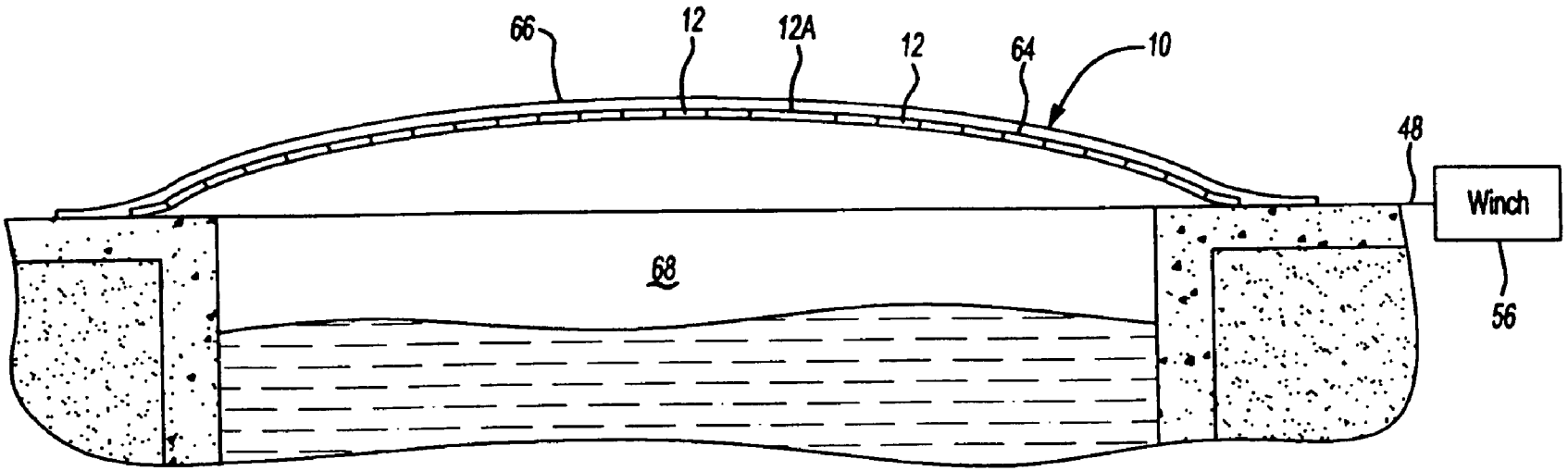
FIG. 14 is a diagrammatic view of a collapsible structural member forming an arch to support a swimming pool cover.

A two dimensional beam 64 is illustrated in FIG. 14 and is made up and curved in a single plane using the basic modules 12 and elongated modules 12A to form the support beam 64 for a flexible cover 66 for a swimming pool 68. In such a cover arrangement to curved beam or beams 64 could be collapsed to permit the beams to be rolled up in the cover 66 to uncover the pool 68.

A collapsible beam structure has been providing a variety of straight or curved structural members of various sizes utilizing a basic module to be molded of plastic material. The basic module 12 is used to form straight beam structures and is modified slightly by repositioning stop elements 50, which determine the angular position of adjacent modules relative to each other. The basic module 12 is further modified to twist the head 16 relative to the head receiving socket 20 as in module 12B or to bend the head portion 16 relative to the socket portion 20 relative to the longitudinal transverse plane 28 of the modules 12 or to elongate the module as in module 12A by separating the head 16 and socket 20 and stretching the skirt portion 18 of the module 12 with a greater distance than the basic module 12. By selecting and arranging the basic module 12 and modified modules 12A, 12B and 12C, regular and irregular configurations of structural beams can be constructed using only a few different modified modules to accomplish the end result.

The beam structure of the present invention are rigid not only in a single plane or three planes but are rigid radially relative to the central axis of all of the modules. The structural strength comes from the frictional locking surfaces and the tensioning cable is required only to maintain the position of the modules.

I claim:

1. A collapsible structural member, the combination of:

a pair of adjacent modules, each of said modules including an elongated body with a head at one end and a substantially peripheral skirt forming a substantially peripherally closed socket at the other end having an interior surface contoured to substantially matingly receive an exterior surface of a head portion of the head of an adjacent module, a substantially radially outwardly facing first frictional locking surface formed by the exterior surface of each of said head portions, a substantially radially inwardly facing second frictional locking surface formed by the interior surface of said substantially peripheral skirts of each of said sockets and being complementary to said first frictional locking surfaces of said head portions, a passage formed by said body members extending longitudinally from said heads to said sockets; and a cable member in said passage of each of said modules and being anchored to one of said modules and being operative upon the application of tension to said cables at the adjacent one of said modules to bring the head portion of said locking surfaces of one module into frictional locking engagement with the second locking surface of the adjacent one of said modules to form a rigid but collapsible structure;

wherein said head portions each have a pair of spaced stop elements and said skirt forms a complementary pair of spaced stop receiving recesses engagable with said stop elements to determine the relative angular position of adjacent modules to each other.

2. The structural member of claim 1 wherein a third frictional locking surface is formed on each of said head portions facing outwardly and oppositely to said first frictional locking surface, and a fourth frictional locking surface formed in each of said sockets facing said second frictional locking surfaces and being complementary to said third frictional locking surfaces, said first though fourth frictional locking surfaces locking adjacent modules to each other upon the application of tension with said cable member to bring said surfaces into engagement with each other.

3. The structural member of claim 2 wherein said first though fourth frictional locking surfaces are substantially spherical.

4. The structural member of claim 2 wherein said first and third locking surfaces are substantially convex and said second and fourth locking surfaces are substantially concave.

5. The structural member of claim 1 wherein said stop elements are disposed at opposite sides of said head portions and are transversely aligned to each other when said adjacent modules are positioned with said longitudinal axes coaxial to each other and are at a selected angle to said transverse aligned position of said stop elements when said modules are disposed at a selected angle to each other.

6. The structural members of claim 1 wherein all portions of said modules are formed as a unit of plastic material.

7. A collapsible structure member, the combination of:

a plurality of adjacent modules, each of said modules including an elongated body with a head at one end and a substantial peripheral skirt forming a substantially peripherally closed socket at the other end having an interior surface contoured to substantially matingly receive an exterior surface of a head portion of the head of the adjacent module, a substantially radially outwardly facing spherical locking surface formed by each of said head portions, a substantially radially inwardly facing spherical locking surface formed by the interior surface of said skirts of each of said sockets and being complementary to said spherical locking surfaces on said head portions of adjacent modules, a passage formed by said body members in each of said modules extending longitudinally from said heads to said sockets; and a cable member extending through said passages of each of said modules and being anchored to one of said modules at one end of said structural member and being operative upon the application of tension at one of said modules at the other end of said structural member to bring the head portion of each module into locking engagement with the socket in the adjacent one of said modules to form a rigid structural member;

wherein said elongated body has a longitudinal axis and a pair of stop members associated with said heads at opposite sides of said longitudinal axis, each of said skirts having an end wall extending transversely to said longitudinal axis, and said stop elements on one module engage said end wall of the adjacent module to determine the alignment of said modules in their locked position.

8. A collapsible structural member, the combination of:

a plurality of adjacent modules, each of said modules including an elongated body with a head at one end and a substantial peripheral skirt forming a substantially peripherally closed socket at the other end having an interior surface contoured to substantially matingly receive an exterior surface of a head portion of the head of the adjacent module, a substantially radially outwardly facing spherical locking surface formed by each of said head portions, a substantially radially inwardly facing spherical locking surface formed by the interior surface of said skirts of each of said sockets and being complementary to said spherical locking surfaces on said head portions of adjacent modules, a passage formed by said body members in each of said modules extending longitudinally from said heads to said sockets; and a cable member extending through said passages of each of said modules and being anchored to one of said modules at one end of said structural member and being operative upon the application of tension at one of said modules at the other end of said structural member to bring the head portion of each module into locking engagement with the socket in the adjacent one of said modules to form a rigid structural member;

wherein said substantially radially outwardly facing spherical locking surfaces are convex and said substantially radially inwardly facing spherical surfaces are concave.

9. A collapsible structure member, the combination of:

a plurality of adjacent modules, each of said modules including an elongated body forming a head at one end and a substantially peripheral skirt forming a substantially peripherally closed socket at the other end having an interior surface contoured to substantially matingly receive an exterior surface of a head portion of the head of the adjacent module, a pair of substantially radially outwardly oppositely facing spherical friction locking surfaces formed by said exterior surface of each of said head portions, a pair of substantially radially inwardly facing concave friction locking surfaces formed by said substantially peripheral wall of said sockets and being complementary to said spherical frictional locking surfaces on said head portions of adjacent modules, a passage formed by said body members in each of said modules extending longitudinally from said heads to sockets; and a cable member extending through said passages of each of said modules and being anchored to said head of one of said modules at one end of said structural member and being operative upon the application of tension to said cable at said one of said modules at the other end of said structural member to bring said pair of convex frictional locking surfaces into locking engagement with said pair of concave frictional locking surfaces in the adjacent one of said modules to form a rigid structural member;

wherein said substantially peripheral skirt has an end wall and wherein stop elements are formed at opposite sides of each of said head portions to engage said end wall of an adjacent module to determine the alignment of the longitudinal axes of adjacent modules.

10. The collapsible structure members of claim 9 wherein said stop elements are disposed in a transverse plane perpendicular to said longitudinal plane of said module when the connected adjacent modules are disposed with their longitudinal axes coaxial to each other and at an angle to said transverse plane when connected modules are to be disposed at an angle to each other to bend said structural member in a single plane.

11. The collapsible structure member of claim 9 wherein said head and skirt of said modules are displaced longitudinally of each other from a first position to a second position to form an elongated body member.

12. The collapsible structure member of claim 9 wherein said heads are turned angularly relative to said skirt about said longitudinal axis to change the direction of an adjacent module of said structural member.

13. The collapsible structure member of claim 12 wherein said head is turned at an angle of up to ninety degrees (90°) relative to said skirt.

14. The collapsible structure of claim 9 wherein said elongated body of each of said modules is symmetrical to a longitudinal plane passing between front and rear walls and extending longitudinally of each of said modules.

15. The collapsible structure member of claim 14 wherein the head portion of selected modules are bent out of said longitudinal planes to form a module to direct the structural member out of said longitudinal plane.

16. The collapsible structure member of claim 14 wherein said head portion is bent out of said longitudinal plane at an angle of no more than about twenty-two degrees (22°) to enable movement of said cable member.

17. The collapsible structural member of claim 9 wherein said modules are made of polyethylene material.

* * * * *